United States Patent [19]

Shapiro et al.

[11] Patent Number: 5,043,738

[45] Date of Patent: Aug. 27, 1991

[54] PLURAL FREQUENCY PATCH ANTENNA ASSEMBLY

[75] Inventors: Sanford S. Shapiro, Canoga Park; Robert A. Witte, Redondo Beach, both of Calif.

[73] Assignee: Hughes Aircraft Company, Los Angeles, Calif.

[21] Appl. No.: 494,012

[22] Filed: Mar. 15, 1990

[51] Int. Cl.[5] ..... H01Q 1/38

[52] U.S. Cl. ..... 343/700 MS; 343/829

[58] Field of Search ..... 343/700 MS, 829, 846, 343/830

[56] References Cited

U.S. PATENT DOCUMENTS

| | | | |
|---|---|---|---|
| 4,364,050 | 12/1982 | Lopez | 343/700 MS |
| 4,554,549 | 11/1985 | Fassett et al. | 343/700 MS |
| 4,847,625 | 7/1989 | Dietrich et al. | 343/700 MS |
| 4,903,033 | 2/1990 | Tsao et al. | 343/700 MS |

*Primary Examiner*—Michael C. Wimer
*Assistant Examiner*—Hoanganh Le
*Attorney, Agent, or Firm*—Mitchell Steven M.; Robert A. Westerlund; Wanda K. Denson-Low

[57] ABSTRACT

A microstrip patch antenna assembly (20, 52, 106) is formed of a patch radiator (24, 58) and a feed structure (26, 64) of microstrip feed elements (48, 50, 66, 68) disposed on opposite sides of a ground-plane element (22, 54) and spaced apart therefrom by layers (28, 30, 72, 74) of dielectric material. A single slot (108) or a pair of orthogonally positioned slots (44, 46, 82, 84) within the ground-plane element couples linearly or circularly polarized microwave power from the feed structure to the patch radiator. Additional radiators (60, 62) may be stacked above the foregoing radiator, the radiators being separated by further layers (76, 78) of dielectric material. A plurality of square-shaped raidators (58, 60, 62) may be employed for multiple-frequency operation in which case the radiator size and the thickness of dielectric material between the radiator and the ground-plane element establish a resonant frequency. A single radiator (24) of rectangular shape may be employed for radiation at dual frequencies wherein short and long edges of the radiator are each equal to one-half of the respective wavelengths in the dielectric material. An array (124) of the antenna assemblies can be constructed in monolithic form for development of a steerable beam of electromagnetic radiation.

4 Claims, 4 Drawing Sheets

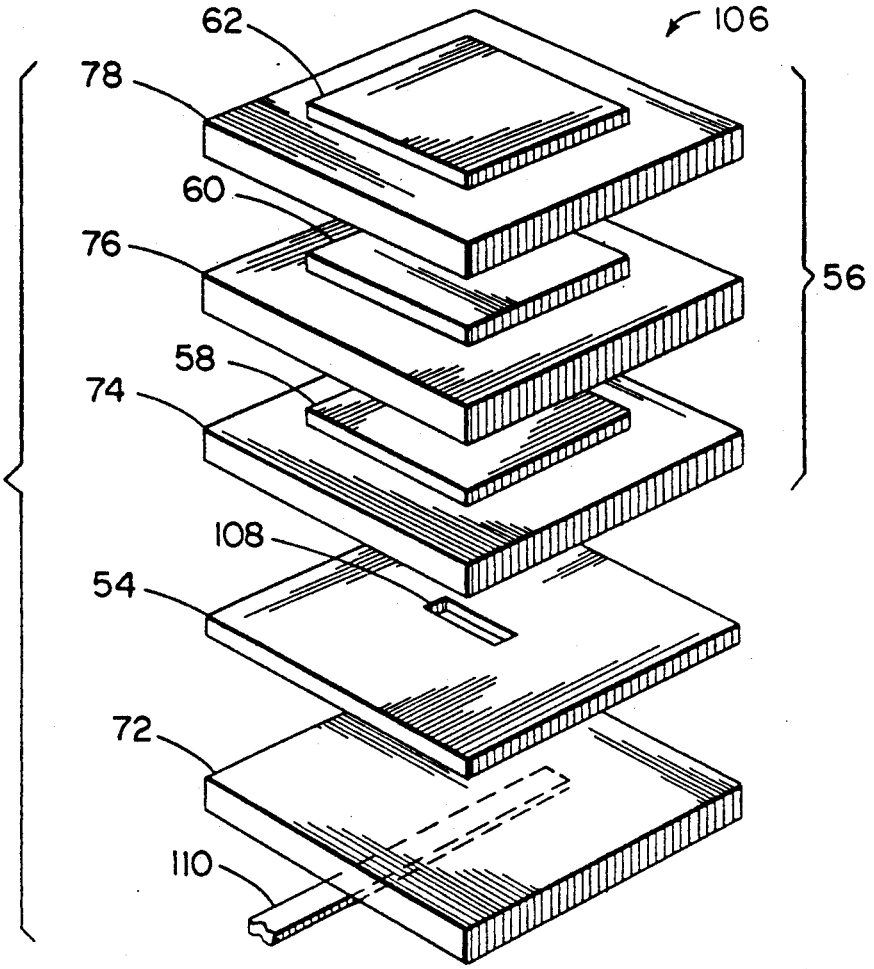
FIG. 6
FIG. 7
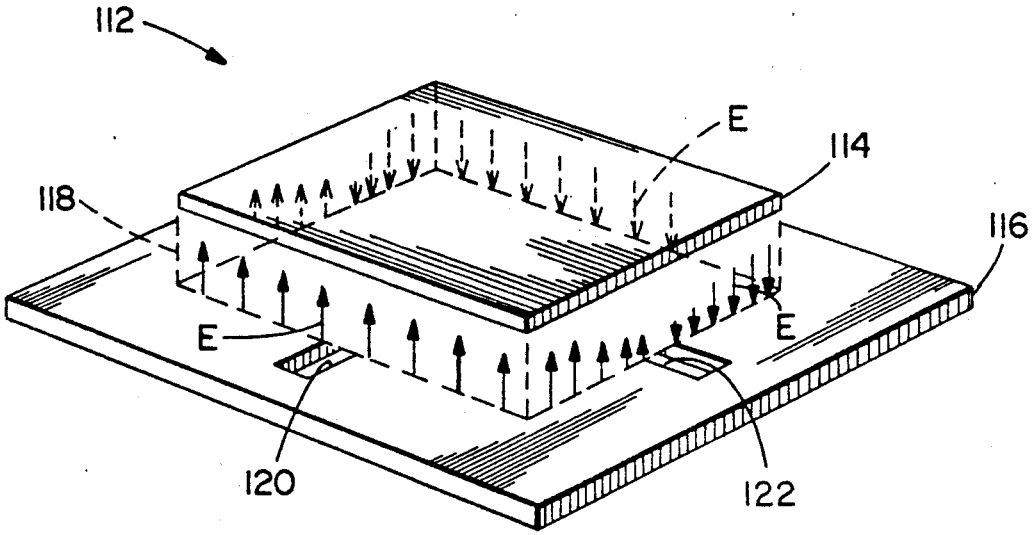

PLURAL FREQUENCY PATCH ANTENNA ASSEMBLY

BACKGROUND OF THE INVENTION

This invention relates to microstrip patch antennas and to arrays of such antennas and, more particularly, to a patch antenna assembly having one or more patch radiators with feed structures for radiation of electromagnetic power at any number of frequencies.

Circuit boards comprising a dielectric substrate with one or more metallic, electrically-conductive sheets in laminar form are used for construction of microwave components and circuits, such as radiators of an antenna filters, phase shifters, and other signal processing elements. Different configurations of the circuit boards are available, three commonly used forms of circuit board being stripline, microstrip, and coplanar waveguide. Of particular interest herein is a laminated antenna structure employing microstrip. The microstrip structure is relatively simple in that there are only two sheets of electrically conductive material, the two sheets being spaced apart by a single dielectric substrate. One of the sheets is etched to provide strip conductors which, in cooperation with the other sheet which serves as a ground plane, supports a transverse electromagnetic (TEM) wave.

A laminated structure of microstrip components facilitates manufacture of antenna assemblies and arrays of antenna assemblies on a common substrate. The relatively simple structure of microstrip permits interconnection with a variety of physical shapes of electronic components, particularly for the excitation of radiators in an array antenna. This provides great flexibility in the layout of the components on a circuit board.

Laminated structures of dielectric material with sheets of metal interposed between the dielectric layers or embedded therein are advantageous because of the ease of manufacture which may employ photolithographic techniques. Specific shapes of metallic elements can be attained by photolithography. This form of construction can be used to advantage in the manufacture of microstrip radiator assemblies for use as single antennas or as antenna elements in an array antenna. The antennas may be employed for radar or for communications. A linearly polarized antenna is preferred where higher output power is required, but circularly polarized radiation is preferred, particularly in mobile communication situations to accommodate changing orientations between a transmitter and a receiver of a communication signal. In addition, it is desirable to have dual or multiple frequency capability wherein frequency bands may be separated, or made contiguous for wide band applications.

A problem arises in that an antenna assembly incorporating the foregoing construction features has not been available for dual or multiple frequency operation in cases of linearly and circularly polarized radiation. The construction of such an antenna assembly or array of radiators would be beneficial from a manufacturing point of view and because of utility in radar and communications.

SUMMARY OF THE INVENTION

The foregoing problem is overcome and other advantages are provided by a microstrip patch antenna assembly comprising, in laminated form and in accordance with the invention, a patch radiator and a feed structure of microstrip feed elements disposed on opposite sides of a ground-plane element. One or more slots are employed for coupling electromagnetic power from a microstrip feed through the ground-plane element to the radiator. The radiator and the feed elements are spaced apart from the ground-plane element by layers of dielectric material. Different embodiments of the invention are provided, the differences being in the number of radiators, the shape of a radiator, and the number of slots disposed in the ground-plane element.

A single slot or a pair of orthogonally positioned slots may be employed, the single slot being disposed between the feed element and an edge of a radiator for exciting a linearly polarized radiation from the radiator. A pair of orthogonally positioned slots connected by a 90 degree hybrid may be employed for generating a circularly polarized radiation from a radiator at a specific frequency or frequency band. A single radiator or a stack of radiators spaced apart by dielectric material may be employed. In the case of the stack of radiators, both the dimensions of a radiator and the overall thickness of the dielectric layers between the radiator and the ground-plane element determine a resonant frequency of operation of the radiator.

By way of example, a stack of square-shaped radiators may be employed with orthogonally positioned feed elements, and a pair of orthogonally disposed slots in the ground-plane element for coupling microwave power from the feed elements to the radiators. By incorporating a hybrid coupler between the feed elements and an external source of signal, the two feed elements produce circular polarized radiation from each of the individual stacked radiators. Microwave power is coupled only to the radiator which resonates at the frequency, or within the frequency band, of the signal provided by the feed elements. By applying a summation of signals at differing frequencies, a plurality of the radiators can be made to radiate concurrently.

In an alternative embodiment, the radiator can be provided with a rectangular shape rather than a square shape. The rectangularly shaped radiator has a short side and a long side for producing radiation having a correspondingly short and long wavelength. A side of the radiator is equal to one-half of the wavelength of the electromagnetic wave propagating in the dielectric material. A null of one electric field, produced by a first of the slots disposed at one side of a radiator, is located on a second side of the radiator in registration with a second of the slots so as to enable independent coupling of microwave power at two different frequencies. In the case of a stack of radiators, only the radiators which resonate at the specific signal frequencies are active, the other radiators being dormant and acting essentially transparent to radiations of the active radiators. A single slot and a single feed element may be employed for linearly polarized radiation.

BRIEF DESCRIPTION OF THE DRAWING

The aforementioned aspects and other features of the invention are explained in the following description, taken in connection with the accompanying drawing wherein:

FIG. 6 is an exploded view, similar to the exploded view of FIG. 4, for an alternative assembly incorporating a single slot for coupling microwave power from a feed element to a radiator;

FIG. 7 shows diagrammatically the electric field in one of the two concurrent orthogonal modes developed between a patch radiator and a ground plane for either of the assemblies of FIGS. 1 and 3;

DETAILED DESCRIPTION

Figure 8:
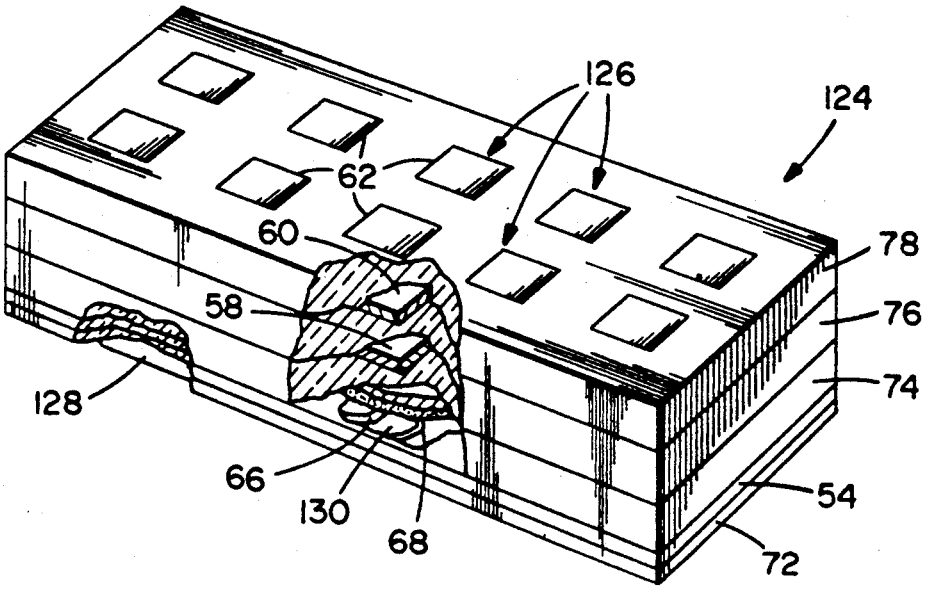
FIG. 8 shows a stylized perspective view of a phased array antenna system constructed of antenna assemblies incorporating the invention, the view being partially cut away to facilitate a showing of components embedded within dielectric layers.

FIGS. 1-6 show various embodiments of a microstrip match antenna, each of which is operable at a plurality of frequencies and which may be employed in the construction of an array antenna disclosed in FIG. 8. In each embodiment of the invention, there is a radiator spaced apart from a ground plane by a dielectric layer, an arrangement which is convenient for the construction of the array antenna wherein the ground-plane element is shared as a common ground plane among a plurality of antenna elements.

With respect to embodiments of the invention employing a plurality of radiating elements arranged in a stack and spaced apart by dielectric layers, each of these antennas is suitable for use as an antenna element in the array antenna wherein the various dielectric layers extend transversely through each of the antenna elements, and wherein individual levels of the stacked radiators of the antenna elements are embedded between contiguous layers of the dielectric. A description of each of the antenna embodiments is presented now in further detail.

Figure 1:
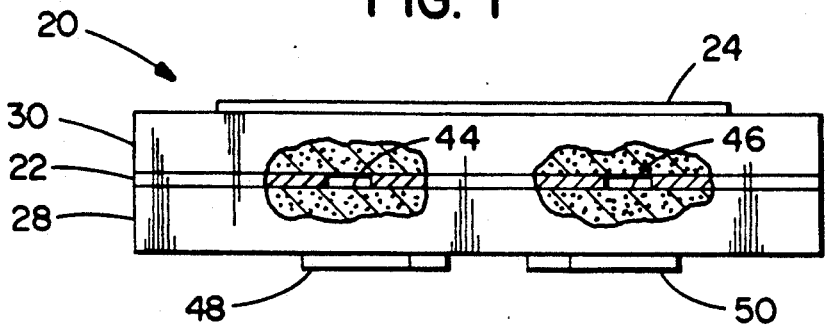
FIG. 1 is a side elevation view of a patch antenna assembly having a rectangularly shaped radiator with dual orthogonal slots coupling the radiator to feed elements for operation at two frequency bands, part of the assembly being cut away to show interior components.
Figure 2:
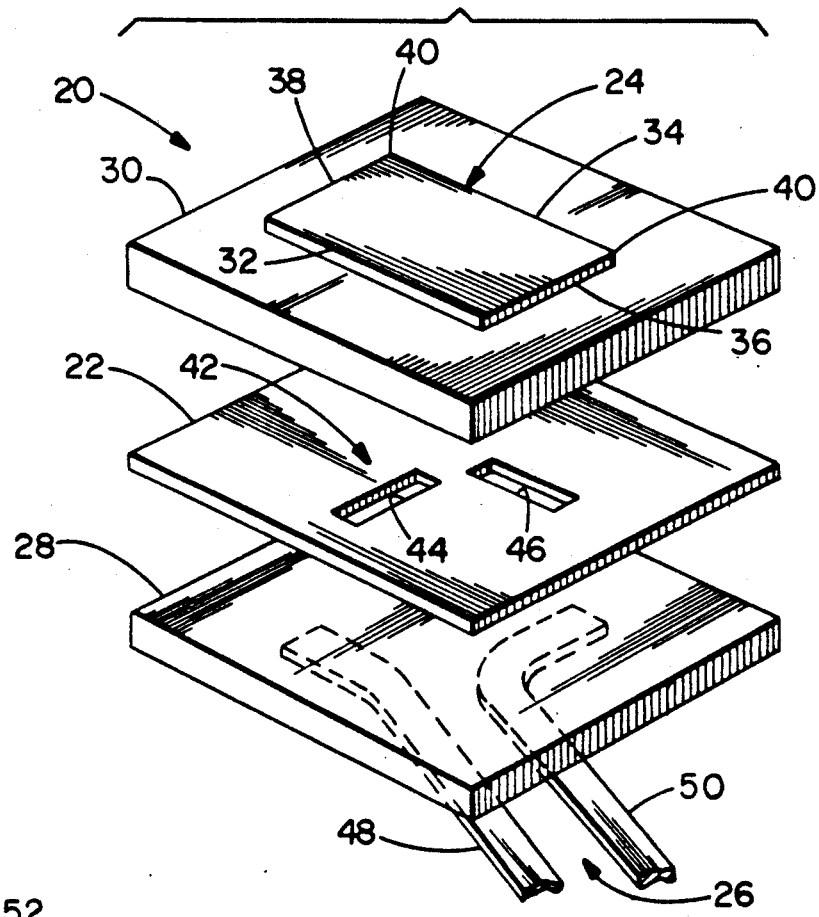
FIG. 2 is an exploded view of the antenna assembly of FIG. 1.

With reference to FIGS. 1 and 2, there is shown an antenna 20 constructed in accordance with a first embodiment of the invention, the antenna 20 comprising a planar ground element 22, a radiator 24 in the form of a planar metallic sheet disposed parallel to the ground element 22, a microstrip feed 26 disposed parallel to the ground element 22 and located on a side thereof opposite the radiator 24, a first dielectric layer 28 of suitable electrically-insulating dielectric material disposed between and contiguous to the ground element 22 and the feed 26, and a second dielectric layer of suitable electrically-insulating dielectric material disposed between and contiguous to the ground element 22 and the radiator 24. The radiator 24 has a rectangular shape, and is bounded by two opposed long sides 32 and 34 and two opposed short sides 36, and 38 which join with the long sides 32 and 34 to form four corners 40 of the radiator 24.

Electromagnetic power to be radiated from the antenna 20 is applied to the antenna 20 by the feed 26, and coupled from the feed 26 to the radiator 24, via a slot assembly 42 comprising two slots 44 and 46 formed within and passing completely through the ground element 22. The two slots 44 and 46 are oriented perpendicularly to each other, and are spaced apart from each other to inhibit coupling of electromagnetic signals between each other. The slots 44 and 46 are perpendicular, respectively, to the long side 32 and the short side 36 of the radiator 24. The slot 44 is located mainly underneath the radiator 24 with an end portion extending beyond the perimeter of the radiator 24. The term "underneath" is used in reference to the portrayal of the antenna 20 in FIGS. 1 and 2, and does not refer to the actual orientation of the antenna 20 which, in practice, may be mounted vertically, sideways, or any other convenient orientation. The end portion of the slot 44 extending beyond the long side 32 is approximately one-third to one-quarter of the total length of the slot 44. Similarly, the slot 46 is disposed mainly beneath the radiator 24 with an end portion of the slot 46 extending beyond the perimeter of the radiator 24. The end portion of the slot 46 extending beyond the short side 36 of the radiator 24 is approximately one-third to one-quarter of the total length of the slot 46.

The feed 26 comprises two electrically conductive microstrip feed elements 48 and 50 each of which has an elongated shape, the feed elements 48 and 50 extending respectively to, and slightly beyond, the slots 44 and 46. The end of each of the feed elements 48 and 50 is in the form of a stub located beneath and perpendicularly to the slots 44 and 46, respectively. With this arrangement of the feed elements 48 and 50 and the slots 44 and 26, a transverse electromagnetic (TEM) wave traveling along a feed element induces an electric field in the corresponding slot, the electric field extending transversely to the long dimension of the slot. In addition, the electric field in each slot radiates upwardly to the radiator 24 and, at a resonant frequency of the radiator 24, couples microwave power from a feed element to the radiator. Thus, a substantial amount of power can be coupled from a feed element via its slot to the radiator 24 in a frequency band centered at the resonant frequency of the radiator 24, there being essentially no power coupled from the feed element to the radiator at frequencies outside the resonant frequency band.

In accordance with a feature of the invention, the radiator 24 resonates at two different frequencies. The resonant frequencies are dependent on the configuration of the radiator 24, and on the thickness and the dielectric constant of the second dielectric layer 30. Since the radiator 24 is configured as a rectangular metallic sheet having both long sides and short sides, the long sides 32 and 34 provide for radiation at a resonant frequency of relatively long wavelength, while the short sides 36 and 38 provide for radiation at a resonant frequency of relatively short wavelength. In the event that the radiator 24 were to have a square shape, then, radiation at only one resonant frequency would be available. However, by introducing even a relatively small difference in length between the long sides and the short sides, two different resonant frequencies are available. Assuming that the frequency bands of radiation centered at the two resonant frequencies overlap, then the effect of utilizing the rectangular configuration, rather than the square configuration, is to broaden the band of frequencies at which radiation can be obtained. In the event that a relatively large difference in length is provided between the long sides 32, 34 and the short sides 36, 38, then two separate frequency bands of radiation are provided by the antenna 20. The signals to be radiated in the separate frequency bands are provided separately by respective ones of the feed elements 48 and 50.

Further description on the development of the electromagnetic fields of the radiations at the different frequency bands will be provided hereinafter with reference to FIG. 7, the description of FIG. 7 being applicable to all of the embodiments of the invention disclosed in FIGS. 1-6. Furthermore, it is noted that, while the description is provided in terms of exciting an antenna by means of the feed for radiating a beam, the antennas in each of the embodiments of FIGS. 1-6 operate reciprocally wherein radiation received by a receiving beam produces output signals at the feed. Accordingly, the description in terms of generating an outgoing beam of radiation is provided for convenience in describing the invention, and applies equally well to the reception of an incoming beam of radiation.

Figure 3:
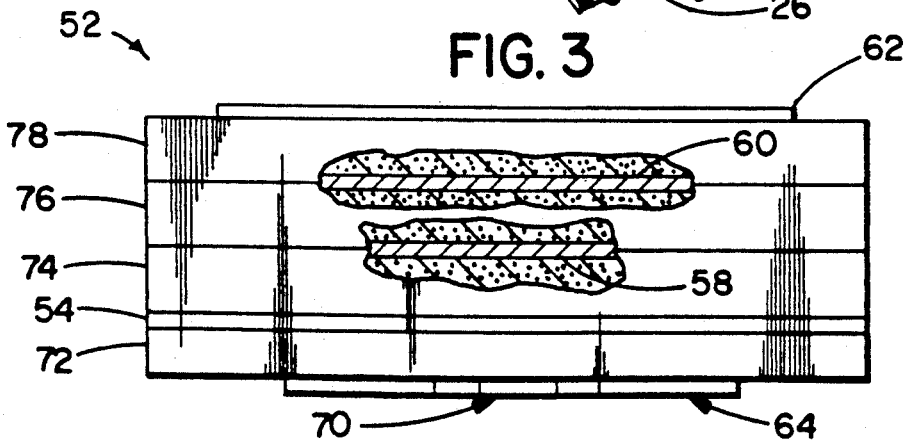
FIG. 3 is a side elevation view of an antenna assembly having a plurality of square-shaped patch radiators embedded in layers of dielectric material, the assembly including dual orthogonal slots and a feed structure incorporating a hybrid coupler for radiating circularly polarized waves at a plurality of frequency bands, which bands may be contiguous for wide band operation, part of the assembly being cut away to show interior components.
Figure 4:
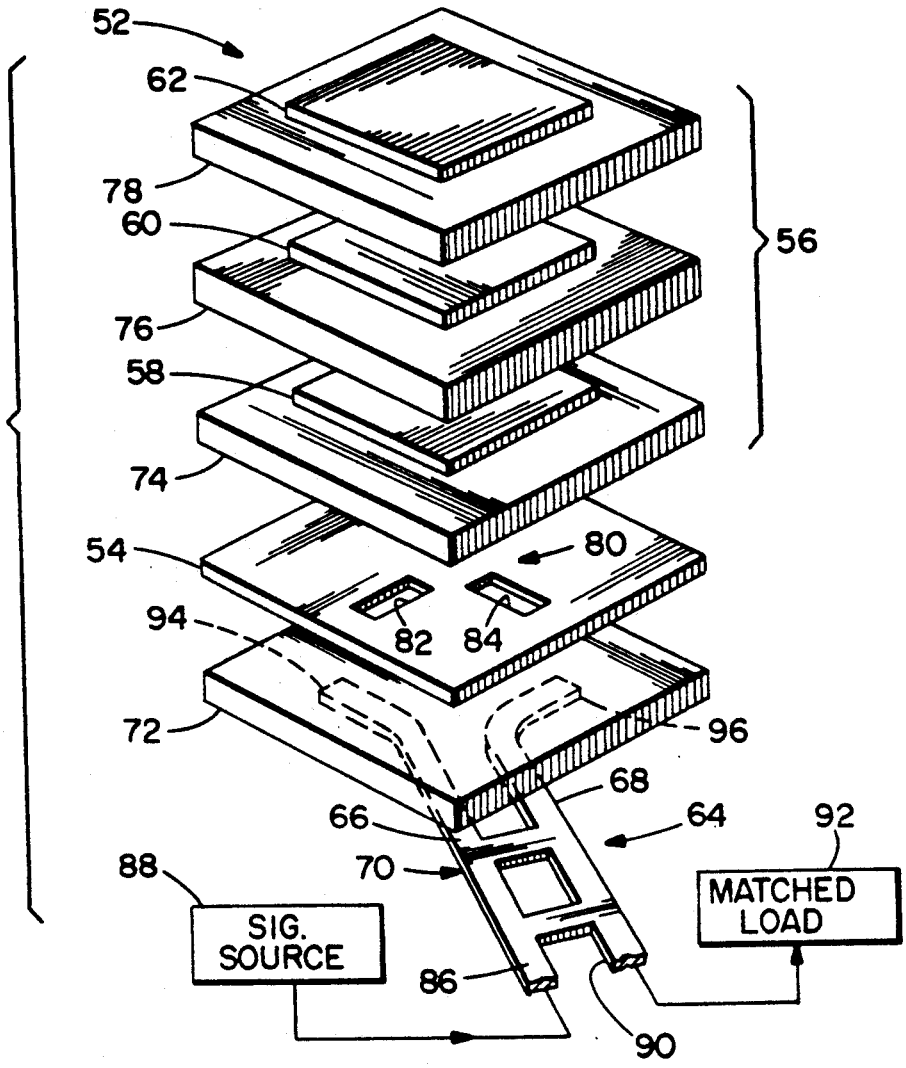
FIG. 4 is an exploded view of the assembly of FIG. 3.

With reference to FIGS. 3 and 4, there is shown an antenna 52 which is a second embodiment of the invention. The antenna 52 is constructed in a similar fashion to that of the antenna 20 of FIGS. 1 and 2, but includes further radiators and a modified structure of the feed. As shown in FIGS. 3 and 4, the antenna 52 comprises a planar ground element 54 and a radiator assembly 56 comprising a plurality of radiators each of which is composed of a thin metallic sheet. There may be two, three, or more of the radiators in the assembly 56. By way of example, the radiator assembly 56 is portrayed as having three of the radiators, namely, a first radiator 58, a second radiator 60, and a third radiator 62 all of which are oriented parallel to the ground element 54.

The antenna 52 further comprises a feed 64 comprising two microstrip feed elements 66 and 68 and a hybrid coupler 70 which joins together the feed elements 66 and 68. The feed 64 lies in a plane parallel to and spaced apart from the ground element 54. The antenna 52 further comprises a first dielectric layer 72 disposed between and contiguous to the ground element 54 and the feed 64. The first, the second, and the third radiators 58, 60, and 62 are spaced apart from each other and from the ground element 54. The antenna 52 includes a second dielectric layer 74, a third dielectric layer 76, and a fourth dielectric layer 78 which are disposed between and are contiguous to, respectively, the ground element 54 and the first radiator 58, the first radiator 58 and the second radiator 60, and the second radiator 60 and the third radiator 62. The material employed in each of the dielectric layers 72, 74, 76, and 78 is selected to have a suitable dielectric constant and to provide suitable electrical insulation. The thicknesses of individual ones of these layers are selected to provide for desired impedance and for desired radiation characteristics.

Each of the radiators 58, 60, and 62 is provided with a square configuration. Coupling of electromagnetic power from the feed 64 to the radiators 58, 60, and 62 is provided by an aperture or slot assembly 80 formed within the ground element 54. The slot assembly 80 comprises a pair of coupling slots 82 and 84 disposed in registration respectively with the feed elements 66 and 68. The slots 82 and 84 are spaced apart from each other, and are oriented perpendicularly to each other to provide for an orthogonal coupling of electromagnetic signals from the feed element 66 and 68 to the radiator assembly 56. The radiators of the assembly 56 are approximately equal in size so as to resonate at approximately the same frequencies, the resonant frequencies of the individual radiators being different from each other so as to provide for a broadened bandwidth of radiation from the assembly 56, the band width of radiation being greater than that obtainable from a single radiator.

It is noted that if all three of the radiators of the assembly 56 were to be equal in size, there would be differences in the respective frequencies of radiation because the amount of spacing between each radiator and the ground element 54 affects the resonant frequency of a radiator as does the dimensions of the radiator. If desired, in the construction of the radiator assembly 56, the thicknesses of the second, the third, and the fourth dielectric layers 74, 76, and 78 can be made to vary or can be made equal as a matter of convenience in selecting the desired resonant frequency of the radiators 58, 60, and 62, and as a convenience in selecting the radiation impedance and bandwidth. In addition, the physical sizes of the radiators, 58, 60, and 62 are selected to facilitate the obtaining of the desired resonant frequency. Typically, the first radiator 58 is fabricated with the smallest dimensions and the third radiator 62 is fabricated with the largest dimensions.

The slots 82 and 84 are fabricated each with a longitudinal form having long sides and narrow ends, the length of a side being much longer than the length of an end. The slots 82 and 84 are each positioned with an inner end extending beneath the three radiators 58, 60, and 62, and with an outer end extending beyond the edges of the radiators 58, 60, and 62. The portion of each of the slots 82 and 84 extending beyond the radiators 58, 60, and 62 is in the range of approximately one-quarter to one-third the total length of the slot. Each of the radiators 58, 60, and 62 are oriented with their respective sides being parallel to each other. Each of the slots 82 and 84 is oriented with the long sides perpendicular to the respective sides of the radiators 58, 60, and 62, and perpendicular also to end portions or stubs of the respective feed elements 66 and 68. The stubs of the feed elements 66 and 68 extend beneath the respective slots 82 and 84 for coupling electro magnetic power through the slots at the respective resonant frequencies of the radiators 58, 60, and 62 for exciting respective ones of the radiators 58, 60, and 62 at their resonant frequencies.

A feature of the invention is attained in the excitation of the radiators 58, 60, and 62 independently of each other by use of the feed 64 and the slot assembly 80. By way of example, at the resonant frequency of the third radiator 62, the other radiators, namely, the first and the second radiators 58 and 60, are dormant and transparent in their electromagnetic operations so as to allow the third radiator 62 to operate free of influence of the presence of the first and the second radiators 58 and 60. Similarly, at the resonant frequency of the second radiator 60, electromagnetic power can be coupled from the feed 64 via the slot assembly 80 to the second radiator 60 to produce a beam of radiation therefrom without any significant effect of the presence of the first and the third radiators 58 and 62. Similar comments apply to the coupling of radiation at the resonant frequency at the first radiator 58 from the feed 64 via the slot assembly 80 to the first radiator 58. The radiation pattern of the first radiator 58 is essentially independent of the presence of the other radiators 60 and 62.

The slots 82 and 84 of FIG. 4 function in the same fashion as do the slots 44 and 46 of FIGS. 1 and 2. However, in FIG. 4 , the frequencies of the signals coupled by the stub ends of the feed elements 66 and 68 via the slots 82 and 84 to the radiator assembly 56 are of equal frequency. If the signals differ in phase by 90 degrees, a phase quadrature relationship, this phase relationship is suitable for the generation of a circularly polarized wave of radiation from any one of the radiators of the radiator assembly 56. In a situation of interest, each of the feed elements 66 and 68 carries a set of plural signals simultaneously, the signals of the set being at three different frequencies corresponding to the resonant frequencies of the radiators 58, 60, and 62. Thereby, the radiator assembly 56 can generate a broad-bandwidth beam of radiation in the case wherein the bandwidth of the signals of the individual radiators 58, 60, and 62 overlap, or three separate frequency bands in the case wherein the resonant frequencies are sufficiently far apart such that the respective frequency bands do not overlap.

The quadrature relationship of the signals of the feed elements 66 and 68 is provided by the hybrid coupler 70. By way of example, a first input port 86 of the hybrid coupler 70 may be coupled to a signal source 88, and a second input port 90 of the hybrid coupler 70 may be coupled to a matched load 92. The signal source 88 applies the signal or set of signals to the coupler 70 to be radiated by the antenna 52, and the matched load 92 receives any reflections which may be presented by the stub ends 94 and 96 of the feed elements 66 and 68, respectively. This is in accordance with the well-known operation of a hybrid coupler. The coupler 70 divides the power evenly and with quatrature phase between the feed elements 66 and 68 to provide for a circularly polarized wave. In the event that the coupler 70 was configured for an unequal division of power among the feed elements 66 and 68, then an elliptically polarized wave would be radiated from the antenna 52.

Figure 5:
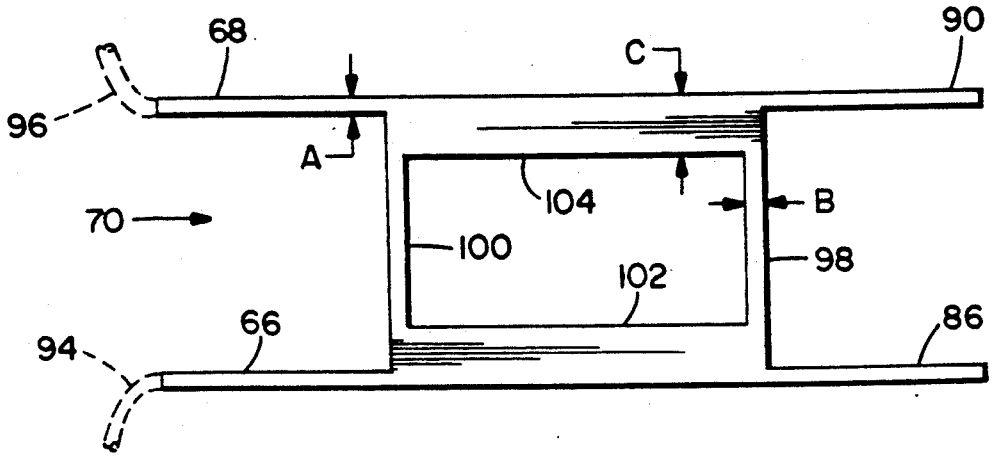
FIG. 5 is an enlarged perspective view of a hybrid coupler, shown partially stylized, of a feed structure of the assembly of FIG. 3.

FIG. 5 presents a detailed plan view of the hybrid coupler 70 of FIGS. 3 and 4. As shown in FIG. 5, the coupler 70 includes a front cross arm 98 and a back cross arm 100 each of which has a width which is less than the width of either of the feed elements 66 and 68. The coupler 70 further comprises two sidearms 102 and 104, the sidearm 102 extending between the input port 86 and the feed element 66, and the side arm 104 extending between the input port 90 and the feed element 68. The side arms 102 and 104 are joined by the cross arms 98 and 100. The side arms 102 and 104 have a width which is greater than the width of either of the feed elements 66 and 68.

By way of example, in the construction of the hybrid coupler 70 with a specific dielectric layer, such as 4 mil thick alumina, the width of the feed element 66 and of the feed element 68, dimension A in FIG. 5, are each equal to 3.7 mils, this being equal also to the width of the input ports 86 and 90. The width of the crossarms 98 and 100, dimension B in FIG. 5, is 1.6 mils. The width of each of the sidearms 102 and 104, dimension C in FIG. 5, is 17.7 mils. The lengths of the cross arms 98 and 100 are selected to introduce a phase shift of 90 degrees, at the specific frequency of operation, to radiations propagating along the sidearms 98 and 100. The sidearms and the cross arms each have the same depth because they are formed by photolithography from a sheet of metal of uniform thickness deposited on the first dielectric layer 72. The thickness is at least three skin depths at the radiation frequency. The foregoing dimensions are accomplished by developing the microstrip coupler on a dielectric slab having a thickness of 4 mils. In the event that a thicker dielectric layer, such as a conventional thickness of 25 mils, were employed, then the foregoing dimensions of the widths of the elements of the hybrid coupler would be enlarged by a scale factor of 25/4. The differences in the widths of the cross arms and the sidearms provides for differences in impedance presented to electromagnetic waves propagating at the input ports 86 and 90 to provide for the desired split in power while providing the phase quadrature relationship to signals outputted from the coupler 70 via the feed elements 66 and 68. The dimensions of the coupler components are scaled, as is well known, to operate at another frequency.

FIG. 6 shows an antenna 106 which comprises the same components as the antenna 52 of FIGS. 3 and 4, except that the slot assembly 80 of the antenna 52 is replaced with a single slot 108 in the antenna 106 and, furthermore, that the feed 64 of the antenna 52 is replaced with a single microstrip feed conductor 110 in the antenna 106. The slot 108 has the same dimensions as the slot 84 of the antenna 52. The slot 108 is centered with respect to the common center of projected radiators 58, 60, and 62 and does not extend beyond the radiators 58, 60, and 62 in the same fashion as was described previously with respect to the slot 84. The slot 108 is perpendicular to an end region, or stub, of the feed conductor 110. Coupling of microwave power from the feed conductor 110 via the slot 108 to radiators of the radiator assembly 56 in FIG. 6 operates in the same fashion as was disclosed with respect to the slot 84 of FIG. 4. The primary difference in operation of the antenna 96 of FIG. 6, as compared to the operation of the antenna 52 of FIG. 4, is that the antenna 106 provides linearly polarized radiation while the antenna 52 provides for circularly polarized radiation. The selection of resonant frequencies and bandwidth of electromagnetic power radiated from the antenna 106 of FIG. 6 is accomplished in the same fashion as was disclosed for the antenna 52 of FIG. 4.

FIG. 7 shows diagrammatically an antenna 112 comprising a top electrically conductive sheet serving as a radiator 114, a bottom electrically conductive sheet serving as a planar ground element 116 disposed parallel to the radiator 114, and a slab 118 of a dielectric, electrically-insulating material disposed between and contiguous to the radiator 114 and the ground element 116. The antenna 112 is provided as an aid in explaining the operation of the various embodiments of the invention disclosed in FIGS. 1–6. The slab 118 is shown in phantom because it is to represent one or more of the dielectric layers of FIG. 4 or the single dielectric layer of FIG. 2. Electromagnetic power for activating the radiator 114 is provided by feed elements (not shown in FIG. 7) coupled via slots 120 and 122 which are disposed in the ground element 116 and extend completely through the ground element 116. The slots 120 and 122 are arranged perpendicularly to each other and spaced apart from each other. Ends of the slots 120 and 122 extend beyond, and perpendicularly to corresponding edges of the radiator 114 as has been disclosed previously in the construction of the slots of FIGS. 2 and 4. The feed elements to be employed in FIG. 7 may be feed elements 48 and 50 of FIG. 2, or the feed elements 66 and 68 of FIG. 4. The electric field distribution, in one of the two concurrent orthogonal modes, shown as a set of electric vectors, E, are superposed upon the surface of the slab 118. The electric field vectors, E, located on the far side of the slab 118 are shown in phantom arrows while the electric field vectors E on the near side of the slab 118 are shown in solid arrows. The antenna 112 of FIG. 7 is understood to include also a dielectric layer (not shown) disposed beneath the ground element 116 and supporting the aforementioned feed elements.

To employ the antenna 112 of FIG. 7 for describing the operation of the antenna 20 of FIG. 2, it is assumed that the radiator 114 represents the radiator 24, that the slab 118 represents the dielectric layer 30, that the ground element 116 represents the ground element 22, and that the slots 120 and 122 represent the slots 44 and 46. The feed element 48 is understood to energize the slot 120 of FIG. 7 as the slot 44 of FIG. 2. Similarly, the feed element 50 is understood to energize the slot 122 of FIG. 7 as slot 46 of FIG. 2.

Upon energization of the slot 122 with electromagnetic power from the feed element 50, the electric field extending transversely across the slot 122 induces a resonant electric field represented by the vectors E, the vectors E extending perpendicularly from the ground plane of the element 116 to the edges of the radiator 114. With reference to the radiator 24, the electric field is portrayed as extending upward to the long side 32 and downward from the long side 34. On the left half of the short side 36 and of the short side 38, the electric field extends in the upward direction while, on the right half of the short side 36 and of the short side 38, the electric field extends in the downward direction. The electric field at the long side 32 and at the long side 34 is of uniform amplitude. The electric field at the short side 36 and at the short side 38 varies in amplitude along a substantially sinusoidal curve wherein the peak amplitude is attained in the vicinity of a corner 40 of the radiator 24, and decreases to zero at a midpoint of the short side 36 and of the short side 38, and then increases in the negative sense to attain a peak value at the opposite corner 40 of the radiator 24.

As has been noted, the foregoing electric field has been excited by electromagnetic power fed through the slot 122 at the frequency of a resonant mode of operation of the radiator 24. In this resonant mode, a wavelength of the radiation is determined by the geometry of the radiator 24 and the thickness and the dielectric constant of the slab 118. As measured within the slab 118, one half the wavelength extends the length of the short side 36.

A feature of the invention is the fact that the slot 122 is positioned at a null in the strength of the electric field induced by radiation from the slot 120. The location of the slot 120 is at the center of the long side 32 of the radiator 24 so that, upon excitation of the electric field by use of the slot 122, the null in the electric field appears at the location of the slot 120. This assures that there is no coupling between radiation of the slot 120 and radiation of the slot 122. Furthermore, this assures that the two slots 120 and 122 can be operated independently of each other to induce separately electromagnetic fields between the radiator 114 and the ground plane provided by the element 116. In the resonant mode of radiation excited by use of the slot 120, one-half wavelength of the radiation, as measured within the material of the slab 18 is equal to the length of the long side 32. Therefore, as has been noted hereinabove, a slight difference in length between the short sides and the long sides of the radiator 24 results in a broadening of the available signal spectrum to be radiated by the antenna 20 or 112 because the bandwidths of the signals of the slots 120 and 122 overlap. However, a relatively large difference in the lengths of the long sides and the short sides of the radiator 24 would separate the the spectra of the two signals so as to provide for two separate frequency bands of radiation.

With respect to the operation of the antenna 52 of FIG. 4, the antenna 112 of FIG. 7 is employed with the radiator 114 representing one of the radiators of the radiator assembly 56 of FIG. 4. By way of example, for purposes of explaining the operation of the antenna 52, the radiator 114 of FIG. 7 is assumed to represent the radiator 60 of FIG. 4, the slab 118 represents the composite thickness of both dielectric layers 74 and 76 of FIG. 4, and the ground plane provided by the ground element 116 represents the planar ground element 54 of FIG. 4. The slots 82 and 84 correspond in the operation to the slots 120 and 122.

The foregoing description of the operation of the antenna of FIG. 2 applies generally to the operation of the antenna 52 of FIG. 4. Thus, with respect to the radiator 60, the slot 82 or 120 provides an electric field distribution as disclosed in FIG. 7, wherein the field lines begin at the ground element 116 and extend to the edges of the radiator 114, this corresponding to an electric field distribution in FIG. 4 extending from the ground element 54 to the radiator 60.

In accordance with a feature of the invention, it is noted that in this description of the generation of the electric field distribution from the slot 120 or 82, the presence of the radiator 58 has been found to have no significant effect on the radiation pattern and on the electric field distribution. Therefore, as has been noted hereinabove, the radiator 58 may be regarded as being dormant when not excited by radiation at its resonant frequency, and as being transparent to radiation generated at the resonant frequencies at another one or ones of the radiators of the radiator assembly 56 in the sense that the excitation of the electric field of the radiator 60 is apparently unaffected by the presence of the radiator 58. The aspect of transparency has b®en observed in experimental models of the invention. The frequency of the resonant mode is based on the total thickness of the slab 118 which, in this case, is equal to the total thicknesses of the two dielectric layers 74 and 76 which are disposed between the radiator 60 and the ground element 54. Furthermore, the presence of the radiator 62 above the radiator 60 has been found experimentally to have essentially no effect on the frequency and electric field distribution of the resonant mode in the excitation of the radiators 60 or 114 via the slot 82 or 120.

Similar comments apply to the excitation of the radiator 60 via the slot 84 because the slots 82 and 84 are located at the midpoint of the sides of the radiator 60 so as to be located at nulls of the electric field distribution provided by the other one of the slots. Therefore, two separate electric field distributions can be reduced independently of each other. In the embodiment of FIG. 4, the radiators are square so that the two resonant modes are at the same frequency. As has been explained hereinabove, the signals provided by the slots 82 and 84 are in phase quadrature so as to produce the circularly polarized electromagnetic radiation which radiates from the radiator 60.

Similar comments apply to excitation of the radiator 62 or the radiator 58 by the slots 82 and 84. Excitation of either of these two radiators 62 and 58 occurs independently of excitation of any of the other radiators of the assembly 56. Thereby, circularly polarized radiation at three separate frequency bands is obtainable. If the resonant frequencies are relatively close together, then the spectra of the separate signals overlap to provide for a broad bandwidth signal radiation characteristic to the antenna 52. If the frequencies of the resonant modes are spaced widely apart, then there is no overlap of the spectra of the signals radiated by the separate radiators of the assembly 56 with the result that three signal spectra, separated in frequency, are radiated from the antenna 52 of FIG. 4.

With reference to the embodiment of the antenna 106 represented in FIG. 6, it is noted that the geometrical relationship among the antenna components is the same as that of the antenna 52 of FIG. 4. In lieu of the two slots 82 and 84 of FIG. 4, or the two slots 120 and 122 of FIG. 7, the antenna 106 of FIG. 6 has only the single slot 108, this corresponding to the slot 122 of FIG. 7. As noted hereinabove, the slot 108 is excited by the microstrip feed element 110 in the same fashion that the slot 84 (FIG. 4) is energized by the feed element 68. Therefore, the description of operation provided by comparison of FIGS. 7 and 4 applies also to the operation of the antenna 106 of FIG. 6. The difference between the operations of the antenna 52 of FIG. 4 and the antenna 106 of FIG. 6 is that, since only one of the slots 120 and 122 of FIG. 7 is energized, only one of the electric field distributions results. Therefore, the antenna 106 can operate at the plurality of frequencies, but with only a linear polarization. The frequency bands of the signals radiated by the antenna 106 may be separated, or may be overlapped to provide for a broad-bandwidth radiation characteristic.

FIG. 8 shows an array antenna 124 which comprises a plurality of antenna elements 126 arranged in a two-dimensional array of rows and columns. Each of the antenna elements 126 may be constructed in accordance with the embodiment of the antenna 20 of FIGS. 1 and 2, the antenna 52 of FIGS. 3 and 4, or the antenna 106 of FIG. 6. By way of example, the antenna 52 of FIGS. 3 and 4 is employed for each of the antenna elements 126. In the construction of the elements 126, the dielectric layers 72, 74, 76, and 78 and the ground element 54 of FIG. 4 are shared among all of the antenna elements 126 of FIG. 8. The third radiator 62, at the top of the antenna 52 of FIG. 4, appears at the top of each of the antenna elements 126. A corner portion of the second radiator 60 and the first radiator 58 appear in a cutaway portion of the array antenna 124. Also shown through the cutaway portion of the dielectric layers and through a cutaway portion of the ground element are portions of the feeds 66 and 68. An electric circuit 128, indicated in a further cutaway portion at the antenna 124 is constructed within the first dielectric layer 72 by photolithographic techniques, the circuit 128 being coupled to each of the antenna elements 126 by their respective feed elements 66 and 68. By way of example, the circuit 128 may include amplifiers and phase shifters, as will be described hereinafter, for applying signals to be radiated from the antenna element 126. Alternatively, the electric circuit 128 may include a receiver connected via feed 130 to each of the respective antenna elements 126 for receiving an incoming signal. In the present example, wherein the antennas 52 of FIG. 4 are employed for the elements 126, each of the feeds 130 is understood to comprise the elements 66 and 68. In the event that the antenna 106 of FIG. 6 is employed, then the feed 130 would comprise a single microstrip feed conductor 110. In the case wherein the antenna 20 of FIG. 2 is employed for each of the antenna elements 126, the feed 130 would be formed as the feed 26. The cutaway portions of the array antenna 124 also show how components of the elements 126, particularly the first and the second radiators 58 and 60 are fully embedded along interfacing surfaces between the dielectric layers 74 and 76 and the dielectric layers 76 and 78. The electric circuit 128 may be formed as one or more integrated circuits formed by photolithography during the construction of the array antenna 124.

Figure 9:
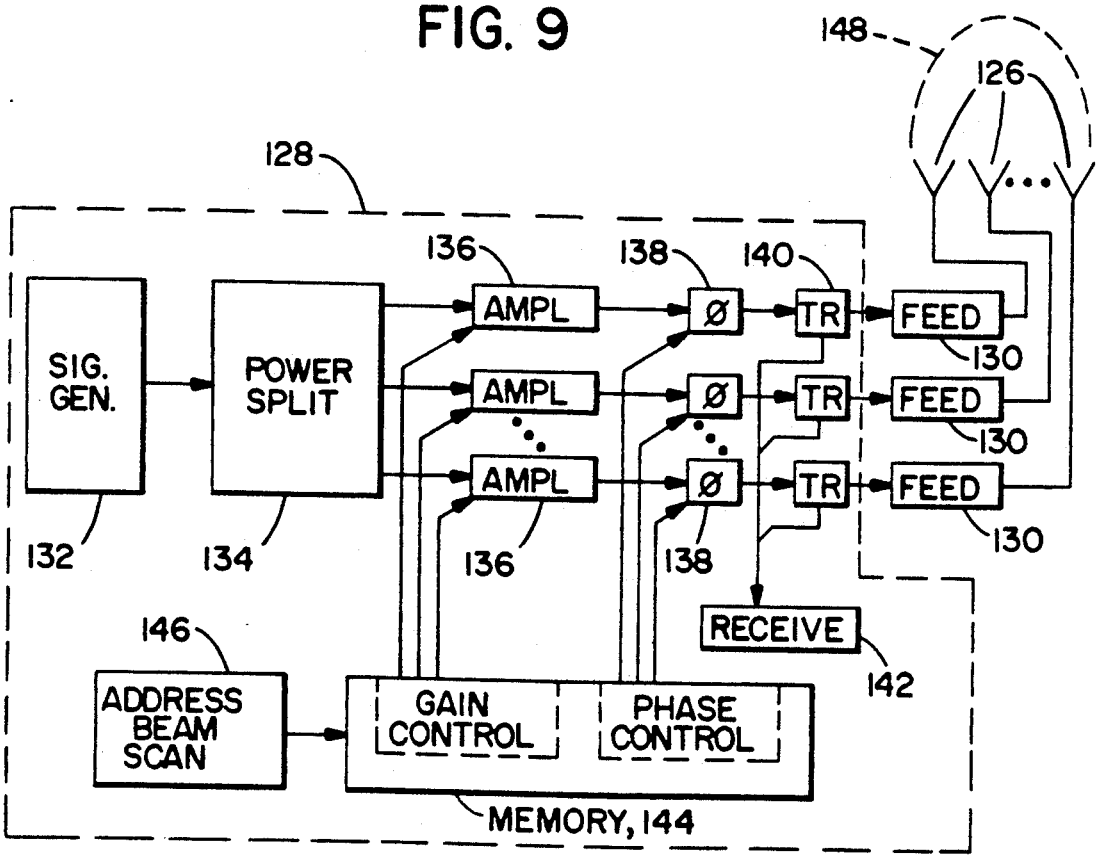
FIG. 9 shows a block diagram of beam generation and steering circuitry connected to the system of FIG. 8 for developing and scanning a beam of radiation.

FIG. 9 shows a possible construction of the electric circuit 128, this construction being by way of example. It is to be understood that the electric circuit 128 may comprise only amplifiers and phase shifters for adjusting a gain and phase of respective ones of the antenna elements 126, with control circuitry of the amplifiers and the phase shifters being located at a site remote from the array antenna 124 with suitable interconnections of the remote circuitry being made to the amplifiers and the phase shifters which are formed as integrated circuit components of the electric circuit 128. Alternatively, if desired, it is possible to include additional components of a transmission or reception system within the electric circuit 128. The latter alternative is shown in FIG. 9. Wherein the electric circuit 128 comprises a signal generator 132, a power splitter 134, a set of variable-gain amplifiers 136, a set of digitally controlled phase shifters 138, a set of transmit receive (TR) circuits 140, a receiver 142, a memory 144 such as a read-only memory including a portion for storage of gain control signals and a portion for storage of phase control signals, and an address unit 146 for addressing the memory 144 to generate and to scan an electromagnetic beam 148 of produced by the antenna elements 126. The beam 148 may be a transmitted beam transmitting a signal provided by the generator 132, or a receiving beam for reception of a signal by the receiver 142.

In operation, for the transmission of a signal via the beam 148, the signal generator 132 generates an electromagnetic signal which is split by the power splitter 134 and applied via the amplifiers 136 to each of the feeds 130 of the respective antenna elements 126. The amplifiers 136 are coupled to the respective feeds 130 by the phase shifters 138 and the TR circuits 140. The amplifiers 136 are responsive to gain control signals stored within the memory 144 for adjusting the gains of the signals of the various antenna elements 126 to produce a desired amplitude taper to an electromagnetic wave radiated from the array of elements 126, thereby to form better the radiation pattern of the beam 148. The phase shifters 138 operate in response to digital phase control signals stored within the memory 144 for forming the beam 148 and for steering the beam in a desired direction relative to the array of elements 126. By operating the address unit 146, the memory 144 can be addressed successively to provide for updating of the gain and the phase control signals for reforming and for steering the beam 148. The TR circuits 140 operate in a well-known fashion to allow the transmitted signal to enter the feeds 130 without affecting the operation of the receiver 142 during a transmission of signals via the beam 148. The TR circuits 140 are operative to direct signals received by the beam 148 to the receiver 142. While the components of the receiver 142 are not shown in FIG. 9, it is to be understood that the components may include a set of phase shifters and a set of amplifiers, such as that shown for the transmitting mode of the circuit 128 for forming and for steering the beam 148 during reception of incoming signals.

With respect to the construction of each of the antenna elements 126, the radiators at the top of each element are portrayed, by way of example, as having a square shape as do the radiators 62 of FIG. 4. However, the feed 64 of FIG. 4 is operative also with a radiator of a different shape, for example, a circular radiator (not shown) which might be employed in the antenna elements 126 of FIG. 8.

With respect to the thickness of the dielectric layers 74, 76 and 78 of FIG. 4, a greater distance between a patch radiator and the ground plane produces an increase in bandwidth to the signal radiated from the antenna 52. Therefore, the radiator 62 at the top of the radiator assembly 56 provides a greater bandwidth to signals radiated from the antenna 52 than does the lower radiator 60 or 58. With respect to the use of the antennas 52 as elements 126 of the array antenna 124 (in FIG. 8), the dielectric layers 74, 76, and 78 should have a thickness less than 0.078 wavelength to prevent the generation of surface waves traveling along a dielectric layer. These surface waves are undesired in the array antenna 124 because, at a slanting scan angle of the beam 148 (FIG. 9), the velocity of the surface wave can be the same as the velocity of the transmitted wave, in which case there is a coupling of power from the transmitted wave to the surface wave with a consequent loss of power transmitted from the array antenna 124.

The material of the dielectric layers 74, 76, and 78 of FIG. 4 may be composed of a blend of glass fibers and a polyfluorinated hydrocarbon, such as a blend of glass fibers and Teflon which is marketed under the name of Duroid. By way of example in the construction of the dielectric layers, construction with the foregoing Duroid results in a dielectric constant of 2.2. As a further example of the dielectric material, fused silica results in a dielectric constant of 3.8, and use of alumina or gallium arsenide provides a dielectric constant of 10.0 or 12.8, respectively. It has been found that the use of a dielectric layer with a lower dielectric constant provides for increased power of the radiated signal. Therefore, in the space between the ground element 54 and the radiating element 58, as well as in the spaces between the ground element 54 and the radiators 60 and 68, it is preferred to use the Duroid or the fused silica. However, in the dielectric layer 72 located beneath the ground element 54, it is preferable to use a material which serves as a substrate for the construction of semiconductor circuitry such as alumina, and particularly gallium arsenide.

By way of example in the construction of the radiators of FIGS. 2 and 4, the side of a radiator measures approximately one-half inch for C-band radiation. The side of a radiator has a length which is approximately 50 per cent longer than the length of one of the slots 44, 46, 82, and 84. Differences in the length of the edges of radiators of the assembly 56 are on the order of approximately 1-2 per cent, typically. A length of a slot is typically on the order of less than 20 per cent of a free-space wavelength, a value of 0.178 wavelength having been employed. The width of a slot is much narrower than the length, the ratio of the length to the width being approximately 7:1. With respect to the positioning of the end portions of the feed element 66 and 68 relative to slots 82 and 84 in FIG. 4, the stubs 94 and 96 extend beyond the slots a distance of approximately one-quarter free-space wavelength, an extension of 0.22 wavelength having been employed in the construction of an embodiment of the invention.

By way of further example in the selection of thickness of the dielectric layers of the various embodiments of FIGS. 1-6, at 7.0 GHz, at a thickness of 25 mils of fused silica dielectric material, a bandwidth of 2.5 per cent is attained, for example, with the antenna 20 of FIG. 2. By way of further example, if the thickness of the dielectric material is increased to 50 mils, the bandwidth is increased to 5.8 per cent. At a thickness of 75 mils, the bandwidth is 10.3 per cent. And at a thickness of 100 mils and 125 mils, the bandwidth is 16.6 per cent and 25.4 per cent, respectively.

With respect to the inclusion of the circuitry of FIG. 9 as the electric circuit 128 in FIG. 8, the circuitry 128 being formed directly within the first dielectric layer 72, it is noted that the physical size of the feeds 130 can be reduced by increasing the dielectric constant of the layer 72. For example, in the case of the gallium arsenide employed in a preferred embodiment of the invention, the dielectric constant has a value of 12.8 which reduces the physical size of the feeds 130, as compared to the use of an air dielectric, by a factor of the square root of the dielectric constant, the size reduction factor being approximately 3.6.

A further feature in the construction of FIG. 8 is that the extension of the ground element 54 among all of the antenna elements 126 effectively shields the radiators of the respective antenna elements 126 from any electrical noise which may be generated within the electric circuit 128. Also, the use of the aperture coupling, wherein slots are constructed within the ground element 54 at the site of each of the antenna elements 126, facilitates manufacture of the array antenna 124.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A microstrip patch antenna comprising:

a ground-plane element;

a first dielectric layer and a second dielectric layer disposed on opposite sides of said ground-plane element;

feed means disposed on a side of said first dielectric layer opposite said ground-plane element for applying signals at plural frequencies to said antenna;

patch radiator means disposed on a surface of said second dielectric layer opposite said ground-plane element; and slot means disposed in said ground-plane element in registration with said feed means, a portion of said slot means extending beyond an edge of said radiator means to couple radiation for exciting said radiator means at said plural frequencies; and wherein said radiator means resonates at each of said plurality of frequencies, said radiator means providing a common radiating aperture of said antenna for radiations at each of said plurality of frequencies;

said patch radiator means comprises a single rectangular patch radiator having a first pair of opposed sides and a second pair of opposed sides with a side of said first pair being longer than a side of said second pair; and said slot means comprises a pair of slots, a first of said slots being located to extend partially beyond an edge of said radiator at a side of said first pair of sides, and a second of said slots being located to extend partially beyond an edge of a side of said second pair of sides.

2. An antenna according to claim 1 wherein said feed means comprises two separate electrically isolated microstrip feed elements each of which is a microstrip conductor element, a first of said feed elements extending transversely across said first slot and a second of said feed elements extending transversely across said second slot, the slots of said pair of slots being orthogonally positioned relative to each other; and said first and said second feed elements provide said signals respectively at a lower frequency and at a higher frequency to excite first and second radiations from said radiator independently of each other at different polarizations and at different frequencies.

3. An array antenna comprising a plurality of antenna elements and a common ground-plane element, each of said antenna elements being disposed on said ground-plane element; and wherein each of said antenna elements comprises:

a first dielectric layer and a second dielectric layer disposed on opposite sides of said ground-plane element;

feed means disposed on a side of said first dielectric layer opposite said ground-plane element for applying signals at a plurality of frequencies to said antenna;

patch radiator means disposed on a surface of said second dielectric layer opposite said ground-plane element, said radiator means resonating at each of said plurality of frequencies, said radiator means providing a common radiating aperture of said antenna for radiations at each of said plurality of frequencies;

slot means disposed in said ground-plane element in registration with said feed means, a portion of said slot means extending beyond an edge of said radiator means to couple radiation for exciting said radiator means at said plural frequencies;

wherein said array antenna further comprises drive circuitry formed within said first dielectric layer and coupled to said feed means in each of said antenna elements for generating a beam of radiation from said array antenna; and in each of said antenna elements said patch radiator means comprises a single rectangular patch radiator having a first pair of opposed sides and a second pair of opposed sides with a side of said first pair being longer than a side of said second pair; and said slot means comprises a pair of slots, a first of said slots being located to extend partially beyond an edge of said radiator at a side of said first pair of sides, and a second of said slots being located to extend partially beyond an edge of a side of said second pair of sides.

4. An array antenna according to claim 3 wherein, in each of said antenna elements, said feed means comprises two separate electrically isolated feed elements each of which is a microstrip conductor element, a first of said feed elements extending transversely across said first slot and a second of said feed elements extending transversely across said second slot, the slots of said pair of slots being orthogonally positioned relative to each other; and said first and said second feed elements provide said signals respectively at a lower frequency and at a higher frequency to excite first and second radiations from said radiator independently of each other at different polarizations and at different frequencies.

* * * * *